United States Patent [19]

De Luca

[11] Patent Number: 5,042,693

[45] Date of Patent: Aug. 27, 1991

[54] MULTI-CONTAINER DISPENSING DEVICE

[75] Inventor: Raymond F. De Luca, Stamford, Conn.

[73] Assignee: Georgia-Pacific Corporation, Atlanta, Ga.

[21] Appl. No.: 370,861

[22] Filed: Jun. 23, 1989

[51] Int. Cl.[5] ..... B67D 5/60

[52] U.S. Cl. ..... 222/145; 222/160; 222/165; 222/181; 222/479; 211/80; 211/81; 141/284

[58] Field of Search ..... 222/64, 180, 181, 129, 222/185, 145, 136, 376, 479, 162, 165, 160, 166; 141/363, 266, 279, 284; 312/248, 247; 211/77-79, 81, 80

[56] References Cited

U.S. PATENT DOCUMENTS 4,324,238 4/1982 Genese et al. ..... 222/145 X
4,402,349 9/1983 Engert et al. ..... 141/284 X

FOREIGN PATENT DOCUMENTS 23975 2/1981 European Pat. Off. ..... 222/160
2331480 1/1974 Fed. Rep. of Germany ..... 222/162

*Primary Examiner*—Michael S. Huppert
*Assistant Examiner*—Gregory L. Huson
*Attorney, Agent, or Firm*—Banner, Birch, McKie & Beckett

[57] ABSTRACT

A device for dispensing fluent supplies comprises an element or elements for positioning a plurality of containers with an open-mouth of each of the containers in a downward position. This device also comprises an element or elements for receiving supplies dispensed from the containers while the containers are positioned by the positioning element or elements in a mouth downward position. In addition, the device comprises an element or elements for adjusting an elevation of an entry point of fluent supply into the supply receiving element or elements of at least one of the mouth downward containers from a first elevation to a second elevation while continuously maintaining at least this one container in an open-mouth downward position.

24 Claims, 5 Drawing Sheets

MULTI-CONTAINER DISPENSING DEVICE

BACKGROUND OF THE INVENTION

This invention relates to automatically assuring that the last mouth downward container loaded into a multi-container dispenser can be oriented in a reserve mode. In other words, this invention relates to allowing the first container in the multi-container dispenser to be the first container out of the dispenser (FIFO) to assure a constant relatively fresh fluent supply.

In certain dispenser applications such as in locker rooms or in factories, heavy surges of consumption are anticipated after workouts or during a shift in a factory. In these situations, there must be fluent supply available when it is needed. The term fluent supply is used to describe the many types of flowable materials which can be used in the claimed dispensers including liquids, granules, pastes or creams.

There have been proposed various large capacity containers in an attempt to meet this need. Large capacity containers, however, are clumsy and difficult to handle and, thus, are prone to have accidental spills. Also, they do not facilitate ease of replacement when they are nearly exhausted and, thus, lead to prolonged interruption of fluent supply.

There have also been proposed the use of two or more containers which dispense fluent supply to the same reservoir, tank, manifold, chamber or the like. In these devices a container can automatically go from a reserve mode to a primary dispensing mode. For example, U.S. Pat. No. 3,927,804 to DeMan or U.S. Pat. No. 3,647,118 to Johnson disclose a plurality of containers in a mouth downward position with the entry point of fluent supply of each of these containers being at varying heights. The entry point of fluent supply into a reservoir of a mouth downward container can be where a container has an open-mouth or it can be at an open end of a nozzle, hose or the like which is connected to the container.

The reservoir of this type of device fills to the point of the highest most entry point of fluent supply so that the container associated with the highest elevation of entry of fluent supply is in the primary dispensing position while the remaining containers are in the reserve position. Thus, when the container associated with the highest entry point of fluent supply is exhausted, the supply level will drop in the reservoir for the second highest entry point of fluent supply container to be in the primary position. The empty container can then be replaced with a new container. The problem with these disclosures is that the replacement bottle which is installed at the higher elevation will go into the primary position and the bottles at the lower elevation entry points of fluent supply may continuously remain in a reserve position.

U.S. Pat. No. 2,962,193 to Totten discloses moving the reserve container to the higher elevation to obtain a first-in-first-out (FIFO) operation in the dispensing of fluids. In particular, when the primary container is exhausted, Totten discloses flipping or rotating both the exhausted primary container and the reserve container from a mouth downward dispensing position to a mouth upward position. Totten then discloses separating the reserve container completely from the dispenser and inserting this same container into the location of the exhausted empty container. A new container is then added where the reserve container was placed. The complete system is flipped again so that both containers are in a mouth downward position. After this reflipping, the prior reserve container is now positioned with its entry point of fluent supply at a higher elevation than it was before servicing so that it is in the primary dispensing position.

Totten suffers from at least two disadvantages, however. First, the steps of flipping both containers to a mouth upward position, physically separating both containers from the dispenser, reinserting a possibly full container and reflipping this assembly provides for complicated and cumbersome servicing. Second, flipping the containers into a mouth upward position and removing the possibly full reserve container for reinsertion into a new position, increases the likelihood that the servicemen could have a spill.

SUMMARY OF THE INVENTION

It is an object of the present invention to more effectively achieve the advantage of the first container in the dispenser being the first container out of the dispenser (FIFO).

It is another object of the present invention to allow adjusting a container from a reserve to a primary position while continuously maintaining at least this one container in an open-mouth downward position.

It is still another object of the present invention to simplify the servicing procedure so that one does not have to flip both containers into a mouth upward position, physically remove the reserve container from the dispenser, reinsert this same container and reflip the assembly in order to obtain a first-in-first-out (FIFO) dispensing order.

It is still a further object to reduce the likelihood of spillage during servicing by not having to remove the possibly full reserve container from the dispensing device and by eliminating the above mentioned clumsy dispenser flipping step.

The present invention is directed toward providing these objectives with a device for dispensing fluent supplies comprising means for positioning a plurality of containers with an open-mounth of each of the containers in a downward position and means for receiving fluent supplies dispensed from the containers while the containers are positioned by the positioning means in a mouth downward position. The device also comprises means for adjusting an elevation of an entry point of fluent supply into the supply receiving means of at least one of the mouth downward containers from a first elevation to a second elevation. The adjusting of one of the containers is done while continuously maintaining at least this one container in an open-mouth downward position.

Another aspect of the present invention is directed toward providing these objectives with the second elevation entry point of fluent supply of a mouth downward container being relatively higher than the first elevation entry point of fluent supply of a mouth downward container. In addition, a first container at the higher second elevation entry point of fluent supply fills the supply receiving means with supply up to the level of the second elevation entry point of fluent supply. A second of the mouth downward containers is at the lower first elevation entry point of fluent supply. Thus, this second container is below the level of fluent supply in the reservoir so that it is not dispensed until the fluent supply of the first container is substantially exhausted.

Included in a preferred embodiment are pivotable means for moving the containers relative to each other so that the entry point of fluent supply of a first of the containers can be adjusted from the first elevation to the second elevation and the entry point of fluent supply of a second of the containers can be simultaneously adjusted from the second elevation to the first elevation.

The various advantages and features of novelty which characterize the invention are pointed out with particularity in the claims annexed hereto and forming a part hereof. However, for better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE PREFERRED EMBODIMENTS

Figure 1:
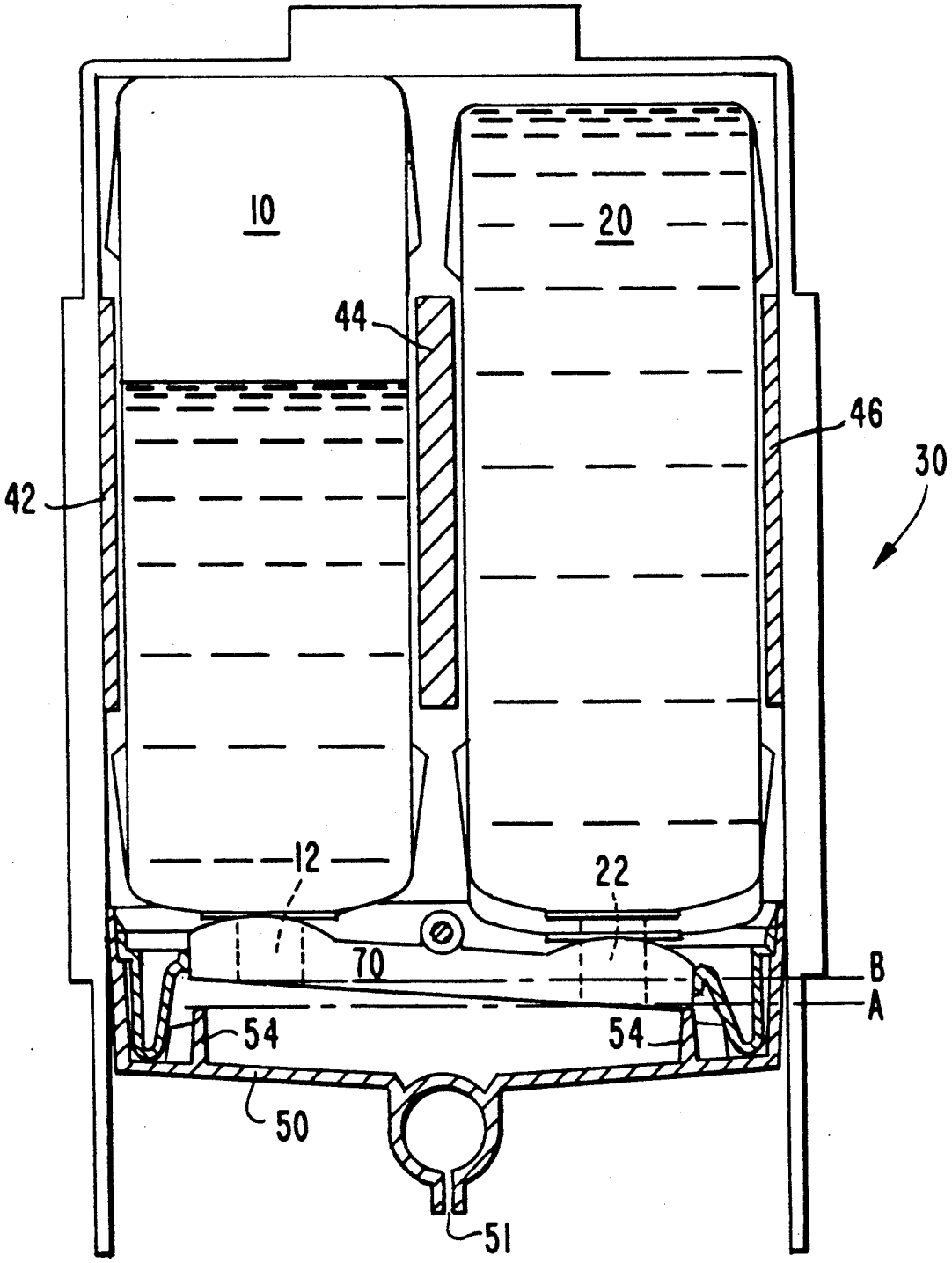
FIG. 1 is a partial, cross-sectional front elevation view of a first embodiment of a multi-container dispensing device in accordance with the present invention.

FIG. 1 illustrates a container 10 and a container 20 in a dispenser 30 for dispensing fluent supplies from these plurality of containers. The containers of bottles 10 and 20 have necks 12 and 22 with open mouths at their ends. These containers are positioned in the dispenser in a mouth downward position. Positioning plates 42, 44 and 46 are located adjacent the sides of these containers to assist in aligning these containers. A reservoir, tank, chamber, manifold or the like 50 receives fluent supplies dispensed from the two mouth downward containers. An outlet 51 in the reservoir 50 dispenses fluent supply from the reservoir to the user.

The plurality of containers are arranged so that the container 10 will be exhausted before the container 20. The open mouth of the container neck 12 is at a higher elevation B relative to the lower elevation A of the open-mouth of the container neck 22. When the container 10 is positioned mouth downward as shown in FIG. 1, the fluent supply will flow into the reservoir 50 and fill the reservoir until the fluent supply reaches level B. At this level B, air is prevented from entering the container 10 so that a vacuum will then form in the upper space of the container 10 and further displacement of fluent supply will be stopped. Drawing fluent supply from the reservoir 50, however, will cause the level to drop below elevation B and allow air to pass into the container 10. The vacuum will then break and the reservoir will fill up to level B again. This sequence of events is repeated with additional draws of fluent supply from the reservoir.

When the container 20 is positioned mouth downward as in FIG. 1, the open-mouth of the neck 22 is placed at the lower elevation A. With the tank supply at level B, a vacuum forms in the upper space of the container 20 and fluent supply from this container 20 will be in a suspended state. Breaking of the vacuum will not occur until fluent supply from container 10 substantially stops and further use causes the supply level in the tank to momentarily drop below level A. At this point, air bubbles pass through the fluent supply in container 20 to break the vacuum in the container and start the flow of fluent supply from the container 20.

Therefore, the container 10 in FIG. 1 is the primary container and the container 20 is the reserve container. With the open-mouth of neck 12 of container 10 at a relatively higher elevation than the open mouth of neck 22 of container 20, the container 10 will be exhausted first.

It is possible to add nozzles, hoses or the like and to make the container heights equal while still maintaining the primary container-reserve container function described above. In the embodiment of FIG. 1, the entry point of the fluent supply from a container is defined by the mouth opening of the end of the necks 12 and 22 of the containers 10 and 20. In certain situations, however, one may find it desirable to install a nozzle, hose or the like to a container so that the entry point of fluent supply from the container into the reservoir would be at the open end of the nozzle which is closest to the reservoir and not at the open-mouth of the container neck. These nozzles, hoses or the like may be of different lengths or they could be of the same length and be threaded, telescoping or otherwise have the ability to be adjusted to different elevations without having to alter the height of their associated containers.

Figure 2:
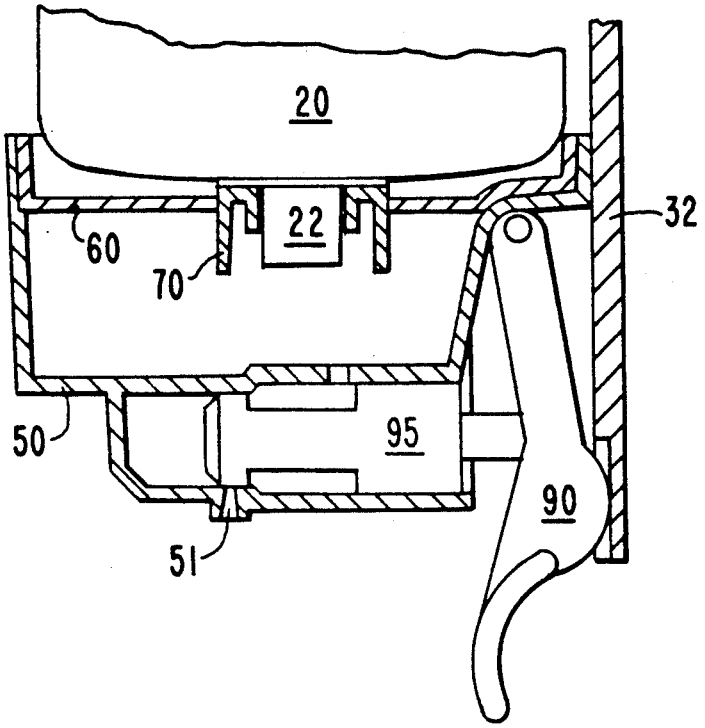
FIG. 2 is a partial, cross-sectional right side view of the lower portion of the dispensing device of FIG. 1.

Illustrated in FIG. 2 is a back plate 32 for attaching the dispenser to the wall and for supporting dispenser elements including the reservoir 50. Although not shown, the positioning plates 42, 44 and 46 are preferably integral with the back plate 32. Also illustrated in FIG. 2 are a handle 90 and a pump 95 which signify any number of conventional elements for selectively controlling the exit of fluent supply from the outlet 51 of the reservoir to the user, for example, as disclosed in U.S. Pat. No. 4,972,978 or U.S. Pat. No. 4,036,406.

Figure 3:
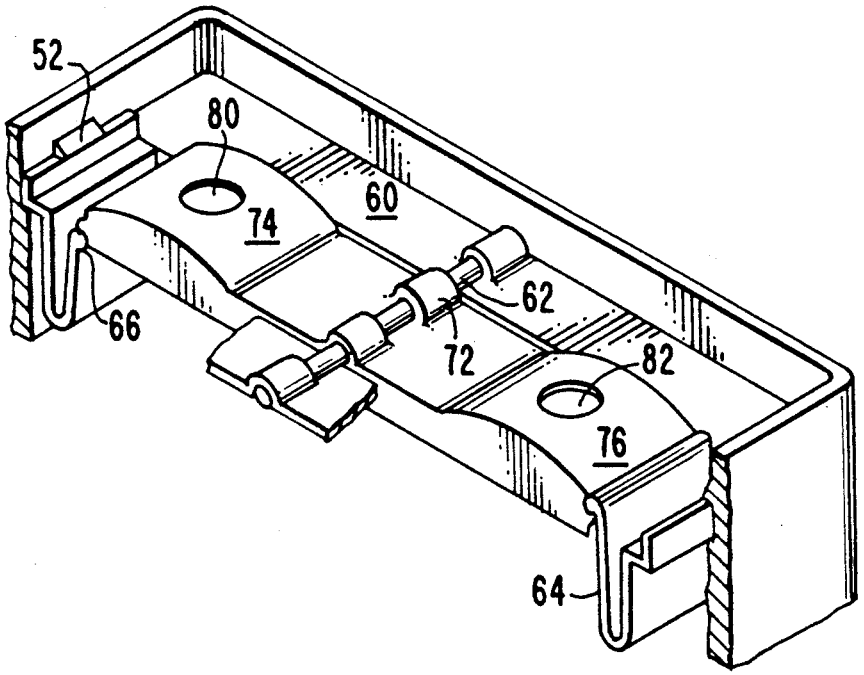
FIG. 3 is a partial perspective view of a lower portion of the dispensing device of FIG. 1 including pivoting elements.
Figure 4:
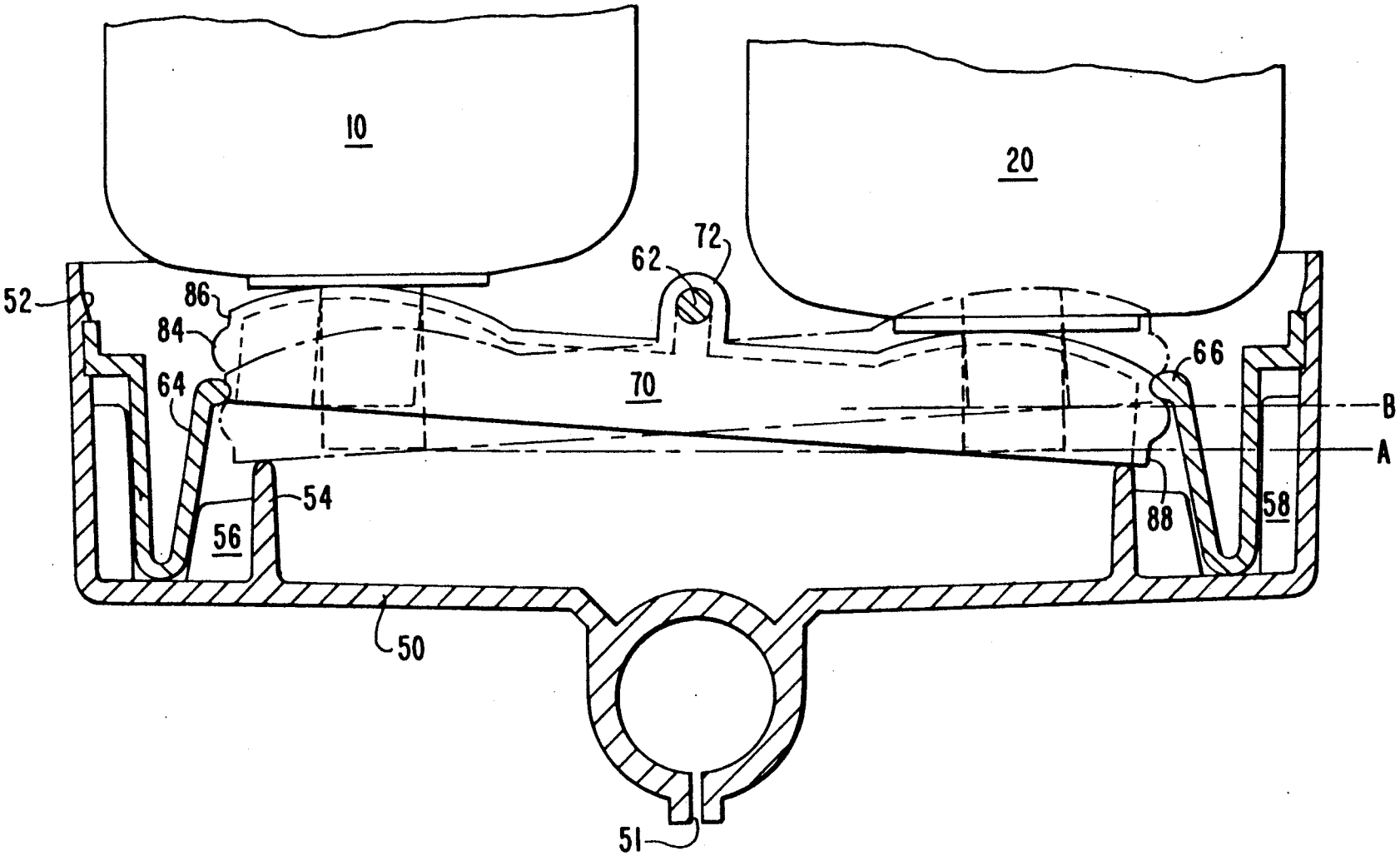
FIG. 4 is a partial enlarged cross-sectional view of a lower portion of the dispensing device of FIG. 1 illustrating the preferred range of motion of the pivoting elements.

Illustrated most clearly in FIGS. 3 and 4 are elements for adjusting the elevation of the entry point of fluent supply into the reservoir 50 of one container from a first elevation A to a second elevation B. Preferably, upon exhaustion of supply from container 10, the container 10 will be discarded and one will wish to adjust the entry point of fluent supply of container 20 (in this case, the entry point of fluent supply is defined by the level of the open-mouth of the container neck 22) from the lower reserve elevation A to the higher primary elevation B.

The preferred embodiment for accomplishing this function includes an arm 70 pivoted or rocked about a fixed position rod 62. This rod 62 can be fixed to a lid 60 of the supply receiving reservoir 50 and disposed across an orifice of this lid 60 as in FIG. 3. Alternatively, this rod could be affixed to the back plate 32 or to some other support element so that the rod 62 can act as a fulcrum and so that the rod can support whatever weight the pivoting arm places on it including, possibly, the weight of full containers.

As illustrated in FIG. 4, this pivoting or rocking arm 70 and its supporting elements allow for adjusting the elevation of the entry point of fluent supply of at least two containers relative to each other. The entry point of fluent supply of a first container 20 can be adjusted from a first elevation A to a second elevation higher elevation B and the entry point of fluent supply of a second container (for example, a new container positioned in the slot vacated by the exhausted container 10) can be simultaneously adjusted from the second elevation B to the first lower elevation A. With this rocking or pivoting motion, the last container placed in the dispenser will go into the reserve position. This series of events can be repeated indefinitely.

Included in this pivoting arm 70 of the preferred embodiment is a center portion 72 about the fulcrum rod 62 and two arm portions 74 and 76 on each side of the center portion 72. Each arm portion 74 and 76 includes at least one orifice 80 or 82 for a receiving a mouth downward container or possibly receiving a hose, nozzle or the like which is connected to a container.

To hold the elevation of fluent supply of a container at a desired first or second elevation in the embodiment of FIGS. 1–4 while still allowing a container to be adjusted between these two elevations, at least one spring-like flexible arm 64 is included. Each flexible arm 64 has an inward directed protrusion 66 which releasably engages or cooperates with a nesting groove 86 or a nesting groove 88 on the pivoting or rocking arm 70. These grooves are separated by a knob 84.

The last container placed in the dispenser can be used to force the adjusting elements to place this new container in the lower reserve position and to raise the container 20 to the higher primary position B. In particular, after the container 10 is emptied and removed from its opening, a new full container can be placed in the same opening. The downward pressure of this new container can cause the left rocker knob 84 in FIG. 4 to move the left flexible arm 64 and its protrusion 66 outward so that the left lower nesting groove 88 is disengaged from the protrusion 66 and the upper nesting groove 86 then engages or cooperates with this protrusion 66. With this rocking motion, the container 20 on the right can be pivoted or rocked from the lower reserve position A to the upper primary position B so that the right protrusion 66 simultaneously moves from engagement with the right upper nesting groove 86 to engagement with the right lower nesting groove 88.

One could, of course, releasably hold the containers in position with a manual latch or some other mechanism so long as the entry point of fluent supply can be held, latched or locked at a first or a second elevation when desired and it can also be adjusted when desired. For example, one could hang a spring-like element from the pivoting rocking arm 70 and have it engage or cooperate with detention elements in the reservoir.

Also preferred and illustrated in FIG. 4 are a plurality of stops 54 which are disposed below each arm portion 74 and 76 of the pivoting arm 70. These stops are for limiting the downward movement of each portion of the pivoting arm 70 so that the entry point of fluent supply from a mouth downward container is no lower than the first elevation.

Ribs 56 and 58 and retaining catches 52 assist in holding the flexible arms 64 in place. These ribs and retaining catches can be integral with the tank. In fact, the stops 54, the flexible arm or arms 64, the lid 60 and/or the fulcrum rod 62 can also be integral with the reservoir.

The pivoting arm 70 may need sufficient strength for supporting a plurality of full containers so the preferred material is Acetal TM by DuPont.

Examples of some functionally equivalent modifications to the embodiments of FIGS. 1–4 include eliminating a separate pivoting arm and pivoting the entire lower portion including the reservoir 50 so that a wall or a lid of the reservoir directly or indirectly causes the entry point of fluent supply of at least one container to be adjusted from a first to a second elevation while continuously maintaining at least this one container in an approximately mouth downward position.

In addition more than two containers can be used in this dispensing device. Some containers may be stored in a mouth upward position or more than one container could be associated with each portion 74 and 76 of the pivoting arm for having more than one container at a first or a second elevation.

Figure 6:
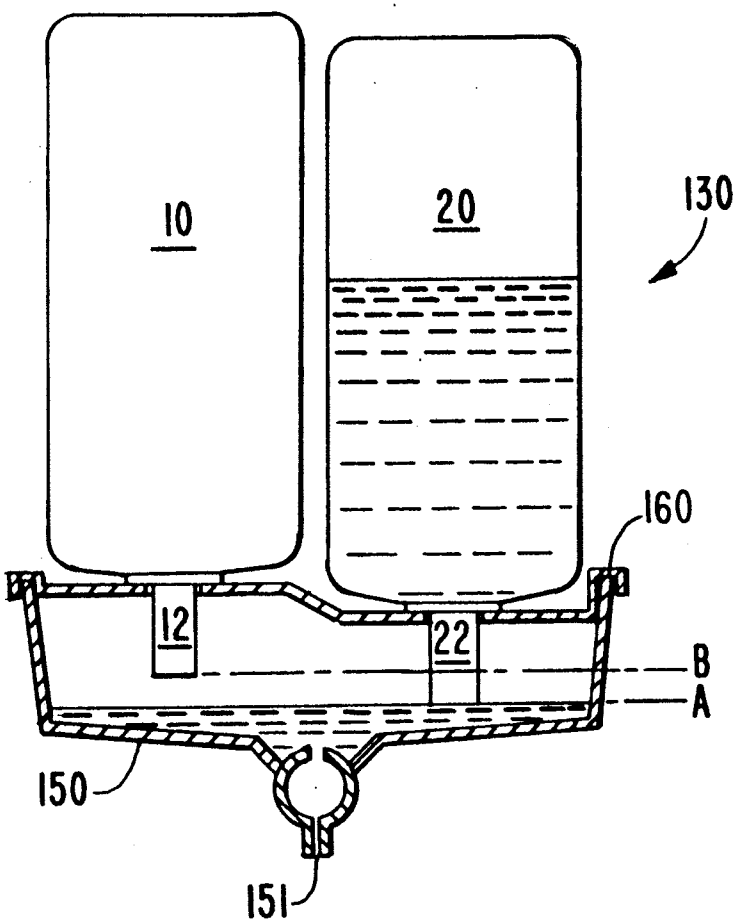
FIG. 6 is a partial, cross-sectional front elevational view of a dispensing device of FIG. 5 in which one container is exhausted.
Figure 5:
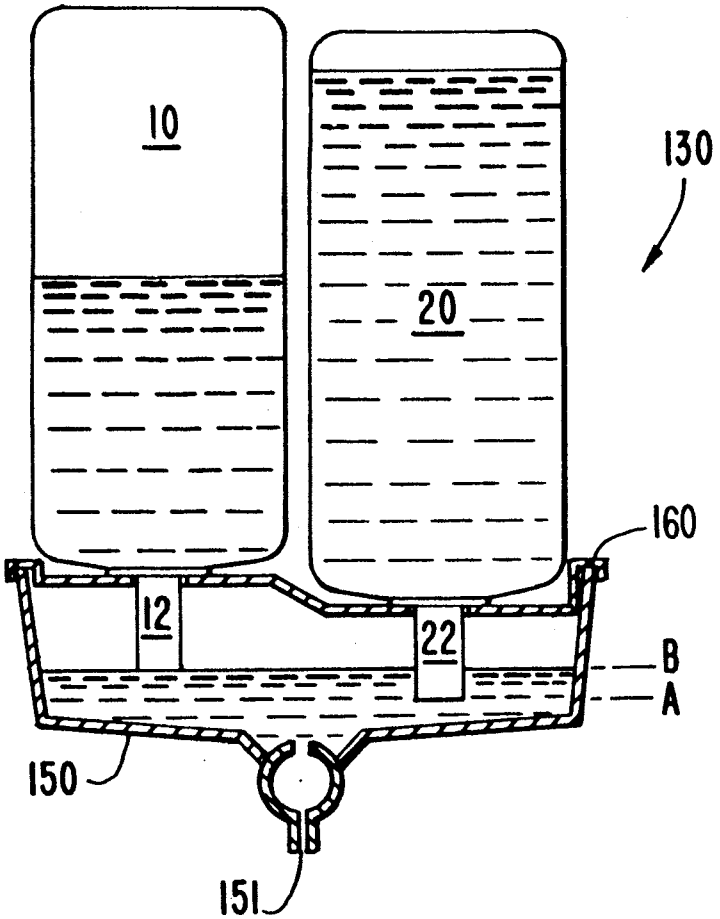
FIG. 5 is a partial, cross-sectional front elevational view of a second embodiment of a multi-container dispensing device in accordance with the present invention.

A second embodiment of FIGS. 5–9 illustrates a dispensing device 130 for adjusting an elevation of an entry point of fluent supply of at least one of the mouth downward containers into a supply receiving reservoir 150 while continuously maintaining at least this one of the containers in an open-mouth downward position. In FIGS. 5 and 6, the container 20 can be guided along an upwardly directed path from the first elevation A to the second higher elevation B.

FIGS. 5–9 also illustrate a lid 160 being disposed substantially over the supply receiving reservoir, manifold, chamber or the like 150. This lid 160 includes a connecting channel 170 having at least two different level substantially horizontal surfaces 172 and 176 with an opening 180 through and between these surfaces. These two different level substantially horizontal surfaces of this embodiment correspond to the first lower elevation A and to the second higher elevation B. This connecting channel 170 can form a recessed portion of the lid to provide support for the neck, shoulders or body of the containers. In addition, the lid could be integral with the tank.

Between the two levels 172 and 176 is a sloping surface 174. This sloping surface assists in sliding an entry point of fluent supply (for example, an open-mouth of the neck 22 of a container 20 as shown) from one lower elevation A to a higher elevation B. The guiding of the container, however, can be done between the two different level substantially horizontal surfaces having a stepped wall or other shaped surfaces between them so long as a common orifice extends into and between the two substantially horizontal surfaces.

Although not shown in FIGS. 5–9, the positioning plates and back plate of FIGS. 1 and 2 can be used to position the containers. The container can be tipped forward during adjustment to a different elevation in order to avoid the positioning plates during transfer from one elevation to another. Also, more than two containers could be serially aligned along a connecting channel if the capacity requirements of the dispenser were larger or the containers were relatively small. In addition, some of the containers could be at the same elevation and some could be at one, two, three or more different elevations along a connecting channel or its functional equivalent.

Figure 7:
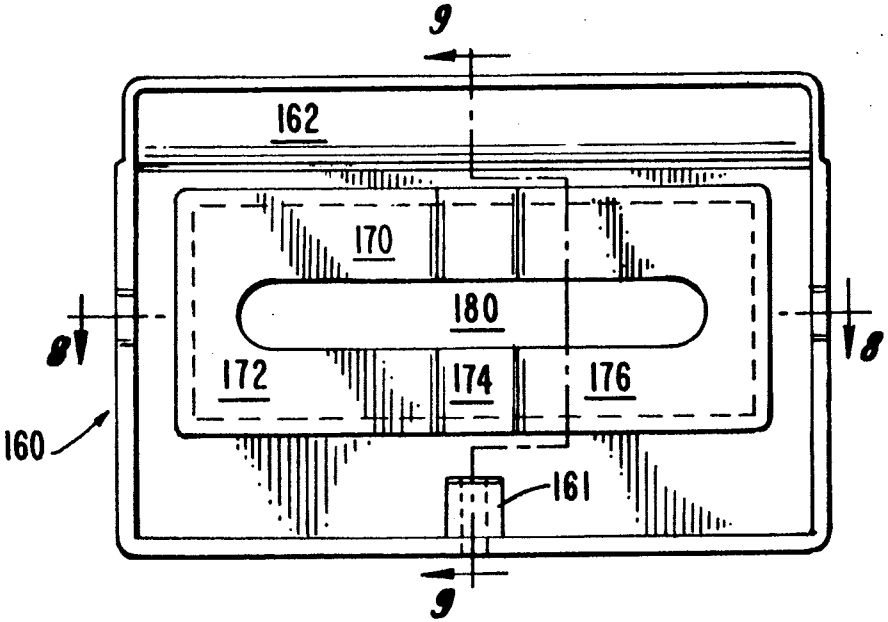
FIG. 7 is a top plan view of a lid of the dispensing device of FIG. 5.
Figure 8:
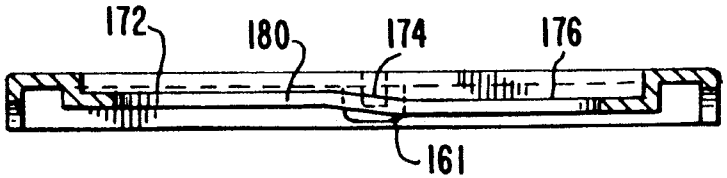
FIG. 8 is a front cross-sectional view along line VIII—VIII of FIG. 7.
Figure 9:
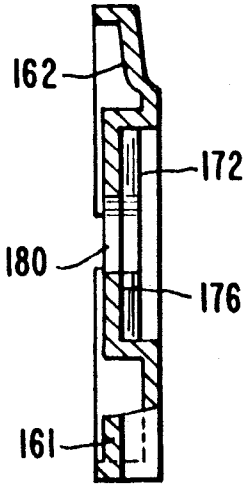
FIG. 9 is a left side cross-sectional view along line IX—IX of FIG. 7.

Also shown in FIGS. 7 and 9 is a hole 161 in the lid 160 to catch any spillage during entry of a full container or exit of the substantially exhausted container. In addition, the lid 160 narrows at position 162 for engagement with the back plate. Further, a reservoir engaging latch 164 is shown.

The reservoirs 50 and 150 are preferably made of a plastic which is impervious to chemicals normally used in dispenser supplies.

With this invention, one can achieve the advantage of the first container in the dispenser being the first container out of the dispenser (FIFO) while continuously maintaining at least one of the containers in a mouth downward position. In other words, one does not have to flip a possibly full reserve container into a mouth upward position and then reflip it into a mouth downward position in order to move or adjust the entry point of fluent supply of this container to a higher elevation primary position.

One advantage of these enhanced functions includes simpler replacement of containers by eliminating the clumsy and cumbersome dispenser flipping steps. Another advantage is a reduction in the likelihood of spillage during servicing, because one does not have to remove the possibly full reserve container from the dispensing device and because the above-mentioned clumsy dispenser flipping steps are eliminated.

With the embodiment of FIGS. 1-4, these simpler service and reduction in the likelihood of spillage advantages are enhanced by the fact the reserve container does not even have to be relocated to move it to a higher primary dispensing elevation.

While the invention has been described in connection with what is presently considered to be the most practical and preferred embodiment, it is to be understood that the invention is not to be limited to the disclosed embodiment, but on the contrary, it is intended to cover various modifications and equivalent arrangements included within the sphere and scope of the appended claims.

I claim:

1. A device for dispensing fluent supplies comprising:

means for positioning a plurality of containers with an open-mouth of each of the containers in a downward position;

means for receiving fluent supplies dispensed from the containers while the containers are positioned by said positioning means in a mouth downward position; and means for adjusting an elevation of an entry point of fluent supply into the supply receiving means of at least one of the mouth downward containers from a first elevation to a second elevation while continuously maintaining at least one container in an open-mouth downward position, wherein the second elevation entry point of fluent supply of a mouth downward container is relatively higher than the first elevation entry point of fluent supply of a mouth downward container, and wherein a first of the mouth downward containers is at the higher second elevation entry point of fluent supply and fills the supply receiving means with supply up to the level of this second elevation entry point of fluent supply and a second of the mouth downward containers is at the lower first elevation entry point of fluent supply, is below the level of fluent supply in the supply receiving means and is not dispensed at least until the fluent supply of the first container is substantially exhausted.

2. A device for dispensing fluent supplies as in claim 1, wherein said adjusting means further comprises means for releasably holding the elevation of the entry point of fluent supply of at least one of the containers at either of the first or second elevations.

3. A device for dispensing fluent supplies as in claim 1, wherein said positioning means further comprises a plurality of means, disposed adjacent each side of each of the mouth downward containers, for aligning the mouth downward containers above said supply receiving means.

4. A device for dispensing fluent supplies as in claim 1, wherein said receiving means further comprises at least one outlet for dispensing fluent supply from the mouth downward containers.

5. A device for dispensing fluent supplies as in claim 1, wherein said elevation adjusting means is disposed substantially between said container positioning means and said supply receiving means and said adjusting means further comprises at least one aperture through which fluent supply is transferred from the mouth downward containers to said supply receiving means.

6. A device for dispensing fluent supplies as in claim 1, wherein said adjusting means adjusts the elevation of the opening of the mouth of at least one of the downward containers from a first elevation to a second higher elevation while continuously maintaining at least this one container in an open-mouth downward position.

7. A device for dispensing fluent supplies as in claim 6, wherein the entry point of fluent supply of each of the mouth downward containers is defined by the opening of the mouth of each of the containers.

8. A device for dispensing fluent supplies comprising:

means for positioning a plurality of containers with an open-mouth of each of the containers in a downward position;

means for receiving supplies dispensed from the containers while the containers are positioned by said positioning means in a mouth downward position; and means for adjusting an elevation of an entry point of fluent supply into the supply receiving means of at least one of the mouth downward containers from a first elevation to a second elevation, including pivotable means for moving the containers relative to each other so that the entry point of fluent supply of a first of the containers can be adjusted from the first elevation to the second elevation and the entry point of fluent supply of a second of the containers can be simultaneously adjusted from the second elevation to the first elevation while continuously maintaining at least one of the containers in an open-mouth downward position.

9. A device for dispensing fluent supplies as in claim 8, wherein said adjusting means further comprises means for releasably holding the elevation of the entry point of fluent supply of the mouth downward containers at either of the first or second elevations and for each mouth downward container held at a first elevation a second mouth downward container can be simultaneously held at a second elevation.

10. A device for dispensing fluent supplies as in claim 8, wherein said pivotable means further comprises a fulcrum mounted in a fixed position relative to the dispenser and an arm which is pivotable about said fulcrum, said arm including a portion on each side of said fulcrum with the movement of one arm portion changing the elevation of the entry point of fluent supply of the first mouth downward container in one direction and simultaneously changing the elevation of the entry point of fluent supply of the second mouth downward container in an opposite direction.

11. A device for dispensinf gluent supplies as in claim 10, wherein the second elevation is relatively higher than the first elevation and said adjusting means also includes means for limiting the downward movement of each portion of said pivoting arm so that the entry point of fluent supply of a mouth downward container is no lower than the first elevation.

12. A device for dispensing fluent supplies as in claim 8, wherein said pivotable means includes:

a lid, mounted between said supply receiving means and said container positioning means, having an opening and a fixed position fulcrum disposed across said orifice; and an arm adjacent said orifice and pivotable about said fulcrum, including a portion on each side of said fulcrum with each arm portion having at least one aperture for receiving a neck of at least one of the mouth downward containers.

13. A device for dispensing fluent supplies as in claim 12, wherein the second elevation is relatively higher than the first elevation and said adjusting means also includes means for limiting the downward movement of each portion of said pivotable arm so that the entry point of fluent supply of a mouth downward container is no lower than the first elevation.

14. A device for dispensing fluent supplies comprising:

means for positioning a plurality of containers with an open-mouth of each of the containers in a downward position;

means for receiving supplies dispensed from the containers while the containers are positioned by said positioning means in a mouth downward position;

pivotable means for moving entry points of fluent supply into the supply receiving means from the mouth downward containers relative to each other so that as one entry point of fluent supply of a first of the mouth downward containers is moved from a first elevation to a second relatively higher elevation, the entry point of fluent supply of a second of the mouth downward containers is simultaneously moved from the second elevation to a first relatively lower elevation;

means for limiting the downward movement of said pivotable means so that the entry point of fluent supply from any mouth downward container is no lower than the first elevation; and means for releasably holding the pivotable means so that one mouth downward container can be releasably held at the first elevation and another mouth downward container can be simultaneously releasably held at the second elevation.

15. A device for dispensing fluent supplies as in claim 14, wherein said pivotable means further comprises:

a fixed position fulcrum;

an arm rotatably associated with said fulcrum, said arm including a portion on each side of the fulcrum with each portion supporting a mouth downward container and with each portion having an aperture for receiving a neck of a mouth downward container; and means for engaging said releasably holding means.

16. A device for dispensing fluent supplies comprising:

means for positioning a plurality of containers with an open-mouth of each of the containers in a downward position;

means for receiving supplies dispensed from the containers while the containers are positioned by said positioning means in a mouth downward position; and means for adjusting an elevation of an entry point of fluent supply into the supply receiving means of at least one of the mouth downward containers from a first elevation to a second relatively higher elevation, including means for guiding at least one of the containers along an upwardly directed path from the first elevation to the second higher elevation while continuously maintaining at least this one container in an open-mouth downward position.

17. A device for dispensing fluent supplies as in claim 16, wherein said guiding means further comprises a lid disposed substantially over said supply receiving means with said lid having at least two substantially horizontal surfaces and having an opening through and between said surfaces.

18. A device for dispensing fluent supplies as in claim 16, wherein said guiding means further comprises a lid disposed substantially over said supply receiving means including a recessed portion of varying depth and one orifice through and between said varying depth recessed portion for repositioning at least one of the mouth downward containers to a higher elevation position while continuously maintaining this container in an open-mouth downward position.

19. A device for dispensing the fluent supplies as in claim 16, wherein, the second elevation entry point of fluent supply of a second of the mouth downward containers is relatively higher than the first elevation entry point of fluent supply of a first of the mouth downward containers; and said guiding means further comprises a connecting channel having a first substantially horizontal surface at the first elevation and a second substantially horizontal surface at the second higher elevation and having an opening running through and between said first and second surfaces so that the entry point of fluent supply of said first of the mouth downward containers can be transferred upwardly from the first to the second relatively higher elevation while continuously maintaining at least the first container in an open-mouth downward position.

20. A device for dispensing fluent supplies as in claim 19, wherein said connecting channel further comprises a sloping surface between and associated with said two substantially horizontal surfaces of said connecting channel.

21. A dispenser for fluent supplies comprising:

means for positioning a plurality of fluent supply containers having downwardly directed open mouths, with a first of said containers in a primary dispensing mode and a second of said containers in a reserve dispensing mode, reservoir means for sequentially receiving fluent supplies from said containers and having a first higher entry level for fluent supplies from the dispenser in said primary dispensing mode and a second lower entry level for fluent supplies from the dispenser in said reserve dispensing mode, and adjustment means for changing the entry level for said second container to said first higher level to convert said second container from said reserve dispensing mode to said primary dispensing mode while maintaining said second container in an open mouth downward orientation, whereby said first container may be replaced by a third container in the reserve dispensing mode.

22. A dispenser for fluent supplies according to claim 21, wherein said entry levels are defined by the open mouths of said first and second containers with the container in said dispensing mode being positioned higher than the container in said reserve mode.

23. A dispenser for fluent supplies according to claim 22, wherein said adjustment means is adapted to simultaneously raise said second container and lower said first container without causing horizontal movement of said containers so that upon each adjustment of said entry levels the horizontal positions occupied by respective containers in said primary dispensing mode and said reserve dispensing mode are reversed.

24. A dispenser for fluent supplies according to claim 22, wherein said adjustment means causes said second dispenser to be moved both vertically to raise its entry level and horizontally to the position last occupied by the first container so that the respective container in said primary dispensing mode is always in the same horizontal position.

* * * * *